US011745050B2

(12) United States Patent
Wang

(10) Patent No.: US 11,745,050 B2
(45) Date of Patent: Sep. 5, 2023

(54) POSITIONING DEVICE FOR A PORTABLE FITNESS EQUIPMENT

(71) Applicant: C2P (TAIWAN) LTD., Taichung (TW)

(72) Inventor: Chin-Liu Wang, Taichung (TW)

(73) Assignee: C2P (Taiwan) Ltd., Taichung (TW)

( * ) Notice: Subject to any disclaimer, the term of this patent is extended or adjusted under 35 U.S.C. 154(b) by 55 days.

(21) Appl. No.: 17/443,299

(22) Filed: Jul. 23, 2021

(65) Prior Publication Data

US 2022/0184451 A1 Jun. 16, 2022

(30) Foreign Application Priority Data

Dec. 16, 2020 (TW) ..... 109144382

(51) Int. Cl.
*A63B 21/00* (2006.01)

(52) U.S. Cl.
CPC ..... *A63B 21/4029* (2015.10); *A63B 21/154* (2013.01); *A63B 2225/093* (2013.01)

(58) Field of Classification Search
CPC ..... A63B 21/00058; A63B 21/00069; A63B 21/00072; A63B 21/0084; A63B 21/0085; A63B 21/0088; A63B 21/018; A63B 21/15; A63B 21/151; A63B 21/153; A63B 21/154; A63B 21/156; A63B 21/225; A63B 21/227; A63B 21/4017; A63B 21/4019; A63B 21/4033; A63B 21/4035; A63B 21/4043; A61H 1/0214; A61H 1/0237; A61H 1/0266; A61H 1/0285
See application file for complete search history.

(56) References Cited

U.S. PATENT DOCUMENTS 3,693,614 A * 9/1972 Schon ..... A61H 1/0214 601/35
6,413,196 B1 * 7/2002 Crowson ..... A63B 69/0002 473/445
7,601,105 B1 * 10/2009 Gipson, III ..... A63B 21/156 482/138
8,517,899 B2 * 8/2013 Zhou ..... A63B 21/0055 482/56
9,539,458 B1 * 1/2017 Ross ..... A63B 21/4043
2003/0017918 A1 * 1/2003 Webb ..... A63B 21/156 482/99
2013/0244804 A1 * 9/2013 Cochran ..... A63B 69/36211 473/218
2014/0243119 A1 * 8/2014 Whalen ..... A63B 61/02 473/493
2015/0182773 A1 * 7/2015 Olson ..... A63B 23/03541 482/92

(Continued)

*Primary Examiner* — Sundhara M Ganesan
*Assistant Examiner* — Zachary T Moore
(74) *Attorney, Agent, or Firm* — Wang Law Firm, Inc.

(57) ABSTRACT

A positioning device for a portable fitness equipment mainly provides a support frame for hanging the portable fitness equipment. The support frame includes a base and a support rod connected to each other, and there is an obtuse angle between the base and the support rod. The obtuse angle design allows the position where the support rod is connected to the base to bear less torque, which can effectively prevent the support rod from shaking or damage; and the portable fitness equipment can slide or can be fixed on the support rod, allowing users to adjust the portable fitness equipment to the most suitable height.

6 Claims, 7 Drawing Sheets

(56) References Cited

U.S. PATENT DOCUMENTS

| | | | | |
|---|---|---|---|---|
| 2016/0151656 | A1* | 6/2016 | Vannicatte | A63B 21/156 482/4 |
| 2018/0221706 | A1* | 8/2018 | Wu | A63B 22/0087 |

* cited by examiner

POSITIONING DEVICE FOR A PORTABLE FITNESS EQUIPMENT

BACKGROUND

Field of the Invention

The present invention relates to a fitness equipment, and more particularly to a positioning device for a portable fitness equipment.

Description of Related Art

There are many types of fitness equipment, including various treadmills, sit-ups, chest expanders, rowers, back expanders . . . etc. The structures of most fitness equipment are mainly to provide users with resistance or gravity, allowing the user to exercise a specific muscle group. There are many ways to provide resistance, including magnetic resistance, wind resistance, weight gain . . . etc.

Existing fitness equipment can not only provide resistance, but also the core part that provides resistance can be removed, which is not only for carrying, but also for the user to train different muscle groups according to the installation position of this fitness equipment, for example: the fitness equipment can be used as a chest expander and back expander if it is installed in a higher position, and if it is installed in a lower position, the fitness equipment can be used as a rowing machine.

However, when general users use the aforementioned fitness equipment, the fitness equipment is fixed to the door panels and railings of the home when it is hung in a high position, and the fitness equipment is fixed on low cabinets when it is hung in a lower position. However, hanging fitness equipment from furniture at home is not only difficult to adjust to the height that is most suitable for the user; moreover, because of the heavy weight of such fitness equipment, it is easy to cause damage to the hanging position when the user exerts force.

In view of this, it is indeed necessary to provide a technical means to solve the aforementioned problem that the fitness equipment does not have the most suitable hanging position.

SUMMARY

One objective of the present invention is to solve the problem that the height of the hanging position of the portable fitness equipment cannot be adjusted, which causes the problem that it is not suitable for users.

Another objective of the present invention is to solve the problem that the hanger of the portable fitness equipment cannot bear the weight and is easily damaged.

To achieve the above objectives, the present invention is a positioning device for a portable fitness equipment, and comprises:

the portable fitness equipment including a connecting portion; and a support frame including a base;

and a support rod standing on the base, the portable fitness equipment being disposed on the connecting portion, a surface of the support rod facing the portable fitness equipment defined as a first surface, a surface of the base facing the portable fitness equipment being defined as a second surface, and an obtuse angle being formed between the first surface and the second surface.

In a preferred embodiment, the connecting portion is additionally provided with a positioning module which includes a first pivot rod and a second pivot rod, the first pivot rod includes one end pivotally connected to the connecting portion, and another end pivotally connected to the second pivot rod, a first grip rod is fixedly connected to the first pivot rod, the support rod is provided with a plurality of positioning holes arranged along an extension direction of the support rod.

In a preferred embodiment, the portable fitness equipment includes an actuating portion connected to the connecting portion via a pivot shaft.

In a preferred embodiment, the portable fitness equipment includes an actuating portion connected to the connecting portion, the connecting portion is additionally provided with a rotating module, the rotating module includes a first pivot member and a second pivot member, the first pivot member includes two ends pivotally to the connecting portion and the second pivot member, respectively, a second grip rod is fixedly connected to the first pivot member, and the actuating portion includes a plurality of through holes that open toward the second pivot member, and each of the through holes is provided for insertion of the second pivot member.

In a preferred embodiment, a direction extending from the support rod to the portable fitness equipment is defined as a horizontal direction, a direction extending from the base to the portable fitness equipment is a vertical direction which is perpendicular to the horizontal direction, a longitudinal direction is perpendicular both to the horizontal and the vertical, and one edge of the base is provided with two rollers arranged along the longitudinal direction.

In a preferred embodiment, a direction extending from the support rod to the portable fitness equipment is defined as a horizontal direction, a direction extending from the base to the portable fitness equipment is a vertical direction which is perpendicular to the horizontal direction, a longitudinal direction is perpendicular both to the horizontal and the vertical, two ropes are connected to two sides of the support rod, the two ropes each have one end connected to two sides of the support rod, and another end arranged along the longitudinal direction and connected to the base, and the another end of each of the two ropes fixed to the base is away from the support rod in the horizontal direction.

In a preferred embodiment, the support frame includes a reinforcing rod and a connecting piece, the reinforcing rod is arranged between the two ropes, an obtuse angle is formed between the reinforcing rod and the base, the reinforcing rod and the support rod are inclined at the same angle and in the same direction, and the connecting piece is connected to the support rod and the reinforcing rod.

In a preferred embodiment, a support assembly includes a top pulley and a bottom pulley fixed on the support rod, and an elastic cord wound around the top pulley and the bottom pulley, one end of the elastic cord is fixed to the top pulley, and another end of the elastic cord is fixed to the connecting portion.

In a preferred embodiment, the portable fitness equipment includes a monitoring device, the monitoring device includes a monitoring circuit and a bracket, the bracket is fixed to the portable fitness equipment, and the monitoring circuit is connected to the bracket through a universal connector.

To achieve the above objectives, the present invention is a positioning device for a portable fitness equipment and comprises:

the portable fitness equipment including a connecting portion; and a support frame including a base; and a support rod standing on the base, the portable fitness equipment being disposed on the connecting portion, a surface of the support rod facing the portable fitness equipment defined as a first surface, a surface of the base facing the portable fitness equipment being defined as a second surface, and a right angle being formed between the first surface and the second surface.

By such arrangements, it not only allows the user to adjust the portable fitness equipment to the most suitable position according to personal needs, but also increases the support of the support rod through the obtuse angle between the support rod and the base. Even if the user pulls the portable fitness equipment forcefully, the support rod can still provide excellent torque resistance and prevent the position where the support rod is connected to the base from loosening or breaking. In addition, stronger support force can be provided through the ropes and the reinforcing rod.

DETAILED DESCRIPTION

Figure 1:
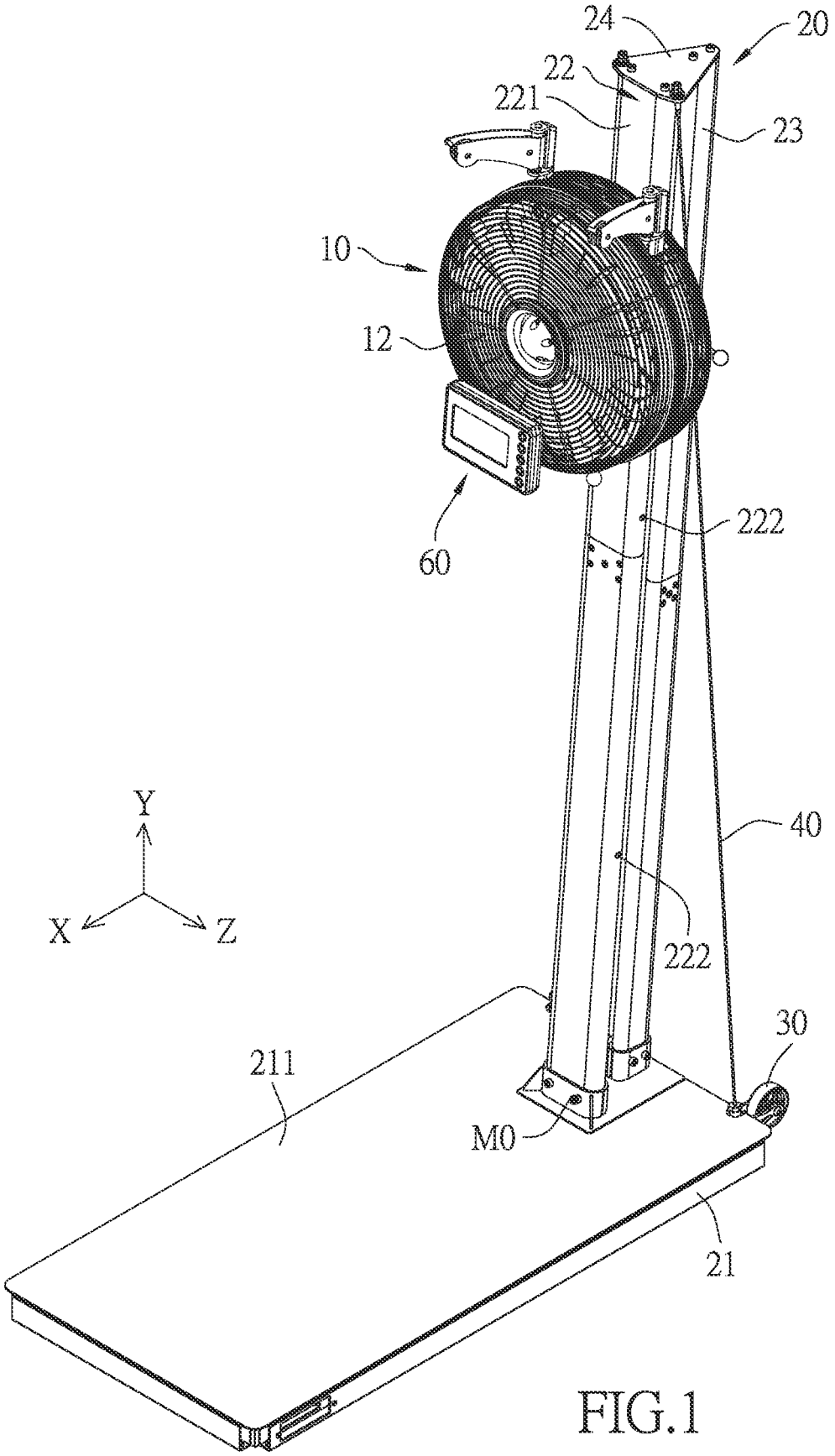
FIG. 1 is a perspective view of the present invention in a preferred embodiment.

Please refer to FIGS. 1 to 4, the present invention is a positioning device for a portable fitness equipment, which mainly includes the portable fitness equipment 10 and a support frame 20.

The portable fitness equipment 10 includes a connecting portion 11; in this embodiment, the portable fitness equipment 10 includes an actuating portion 12 connected to the connecting portion 11, and the actuating portion 12 is provided for the user to do workout. A sliding channel 111 runs through the connecting portion 11.

The support frame 20 includes a base 21, and a support rod 22 standing on the base 21. The portable fitness equipment 10 is disposed on the connecting portion 11. A surface of the support rod 22 facing the portable fitness equipment 10 is a first surface 221, a surface of the base 21 facing the portable fitness equipment 10 is a second surface 211, and there is an obtuse angle θ1 between the first surface 221 and the second surface 211; In this embodiment, the portable fitness equipment 10 is sleeved on the support rod 22 through the sliding channel 111, so that the portable fitness equipment 10 can slide along the extension direction of the support rod 22.

In this embodiment, the connecting portion 11 is additionally provided with a positioning module 13 which includes a first pivot rod 131 and a second pivot rod 132. The first pivot rod 131 includes one end pivotally connected to the connecting portion 11, and another end pivotally connected to the second pivot rod 132. A first grip rod 133 is fixedly connected to the first pivot rod 131. Pulling the first grip rod 133 causes the second pivot rod 132 to approach or move away from the support rod 22. The support rod 22 is provided with a plurality of positioning holes 222 arranged along the extension direction of the support rod 22. When the portable fitness equipment 10 slides along the support rod 22 and needs to be positioned and fixed, pulling the first grip rod 133 can insert the second pivot rod 132 into one of the positioning holes 222, so as to fix the portable fitness equipment 10.

Secondly, the actuating portion 12 and the connecting portion 11 are connected through a pivot shaft 14 so that the actuating portion 12 can rotate around the pivot shaft 14; the connecting portion 11 is additionally provided with a rotating module 15. The rotating module 15 includes a first pivot member 151 and a second pivot member fourth pivot rod 152. The first pivot member 151 includes two ends pivotally to the connecting portion 11 and the second pivot member 152, respectively. A second grip rod 153 is fixedly connected to the first pivot member 151. Pulling the second grip rod 153 causes the second pivot member 152 to approach or move away from the actuating portion 12. The actuating portion 12 includes a plurality of through holes 121 that open toward the second pivot member 152, and each of the through holes 121 is provided for insertion of the second pivot member 152, thereby fixing the actuating portion 12 and preventing it from rotating about the pivot shaft 14. On the contrary, when the second pivot member 152 is disengaged from the through hole 121, the actuating portion 12 can rotate about the pivot shaft 14.

Furthermore, a direction extending from the support rod 22 to the portable fitness equipment 10 is defined as a horizontal direction X, a direction extending from the base 21 to the portable fitness equipment 10 is a vertical direction Y which is perpendicular to the horizontal direction X, and a longitudinal direction Z is perpendicular both to the horizontal X and the vertical Y. One edge of the base 21 is provided with two rollers 30 arranged along the longitudinal direction Z. Through the two rollers 30, only by tilting the base 21, the positioning device of the entire portable fitness equipment can be moved.

Preferably, the invention further includes two ropes 40 connecting two sides of the support rod 22. The two ropes 40 each have one end connected to two sides of the support rod 22, and another end arranged along the longitudinal direction Z and connected to the base 21. The another end of each of the two ropes 40 fixed to the base 21 is away from the support rod 22 in the horizontal direction X, and the support rod 22 is pulled through the two ropes 40. When the user pulls the portable fitness equipment 10 in the direction of a force F, the two ropes 40 can provide more support.

Finally, the support frame 20 includes a reinforcing rod 23 and a connecting piece 24. The reinforcing rod 23 is arranged between the two ropes 40, and an obtuse angle θ2 is sandwiched between the reinforcing rod 23 and the base 21. The angles and directions of the inclination of the reinforcing rod 23 and the support rod 22 are the same. The connecting piece 24 connects the support rod 22 and the reinforcing rod 23, so that the force acting on the support rod 22 can be distributed to the reinforcing rod 23, and thus improving overall support.

Figure 5:
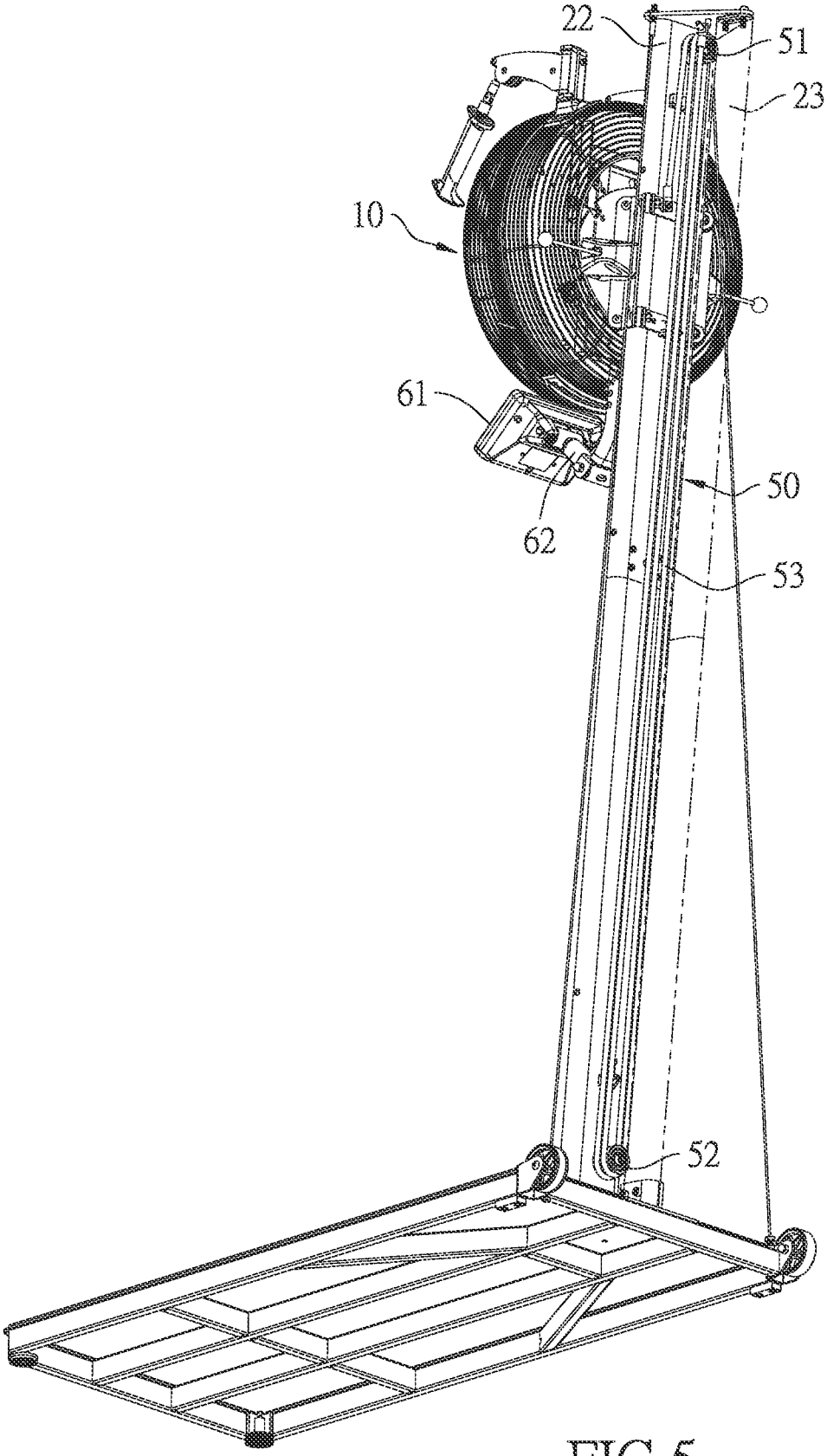
FIG. 5 is a perspective view of the present invention in a second preferred embodiment.

Please refer to FIG. 5, a second embodiment of the present invention further includes a support assembly 50. The support assembly 50 includes a top pulley 51 and a bottom pulley 52 fixed on the support rod 22, and further includes an elastic cord 53 wound around the top pulley 51 and the bottom pulley 52 in such a manner that one end of the elastic cord 53 is fixed to the top pulley 51, and another end of the elastic cord 53 is fixed to the connecting portion 11. Thereby, when the user slides the portable fitness equipment 10, the elastic cord 53 will be stretched to provide support to the portable fitness equipment 10, which can not only prevent the portable fitness equipment 10 from shaking, but also provide sufficient elastic support for the portable fitness equipment 10.

Figure 2:
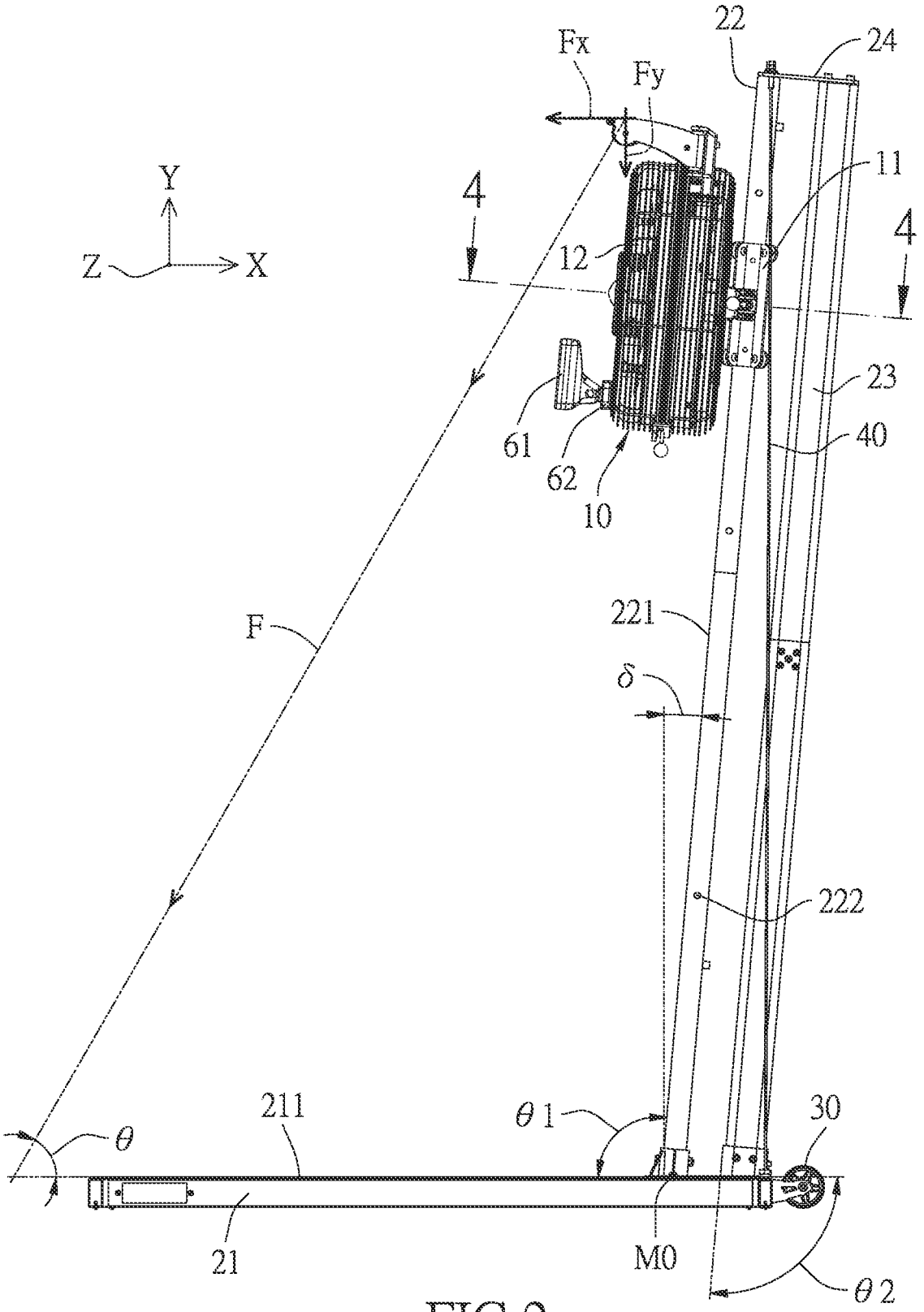
FIG. 2 is a side view of the present invention in a preferred embodiment.
Figure 3:
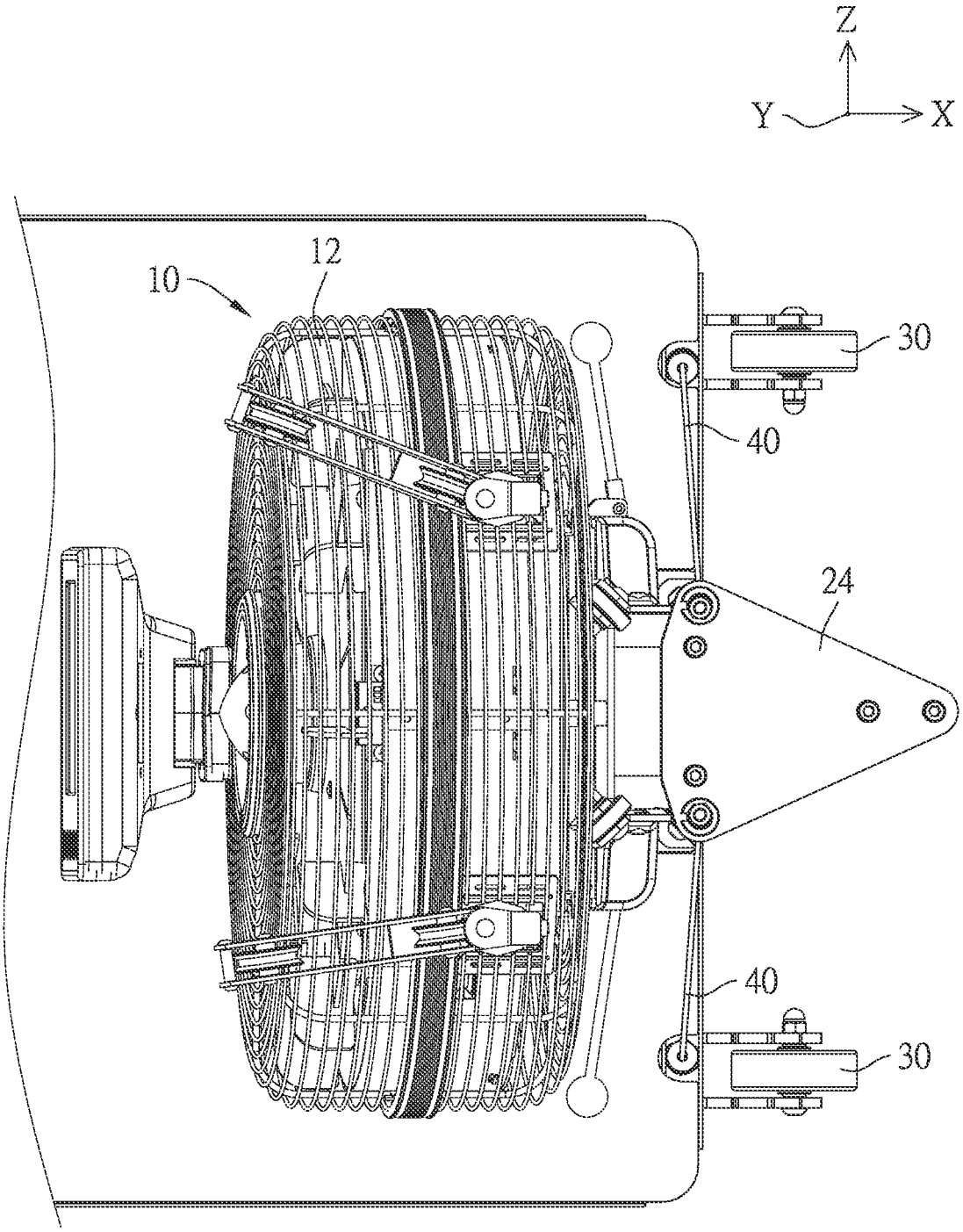
FIG. 3 is a top view of the present invention in a preferred embodiment.

Please refer to FIGS. 1, 2, and 5, the present invention also includes a monitoring device 60 on the portable fitness equipment 10, the monitoring device 60 includes a monitoring circuit 61 and a bracket 62, the bracket 62 is fixed to the portable fitness equipment 10, and the monitoring circuit 61 is connected to the bracket 62 through a universal connector, so that the monitoring circuit 61 can rotate about the bracket 62 at any angle or in any direction arbitrarily. Thereby, when the user moves the portable fitness equipment 10 to the top or bottom of the support frame 20, the orientation of the monitoring device 60 can be adjusted according to the position of the portable fitness equipment 10 and the height of the user, so as to allow the user to conveniently look directly at the monitoring device 60 in any use state, which also reflects the advantageous effect of the portable fitness equipment 10 being able to repeatedly move on the support frame 20.

Figure 6:
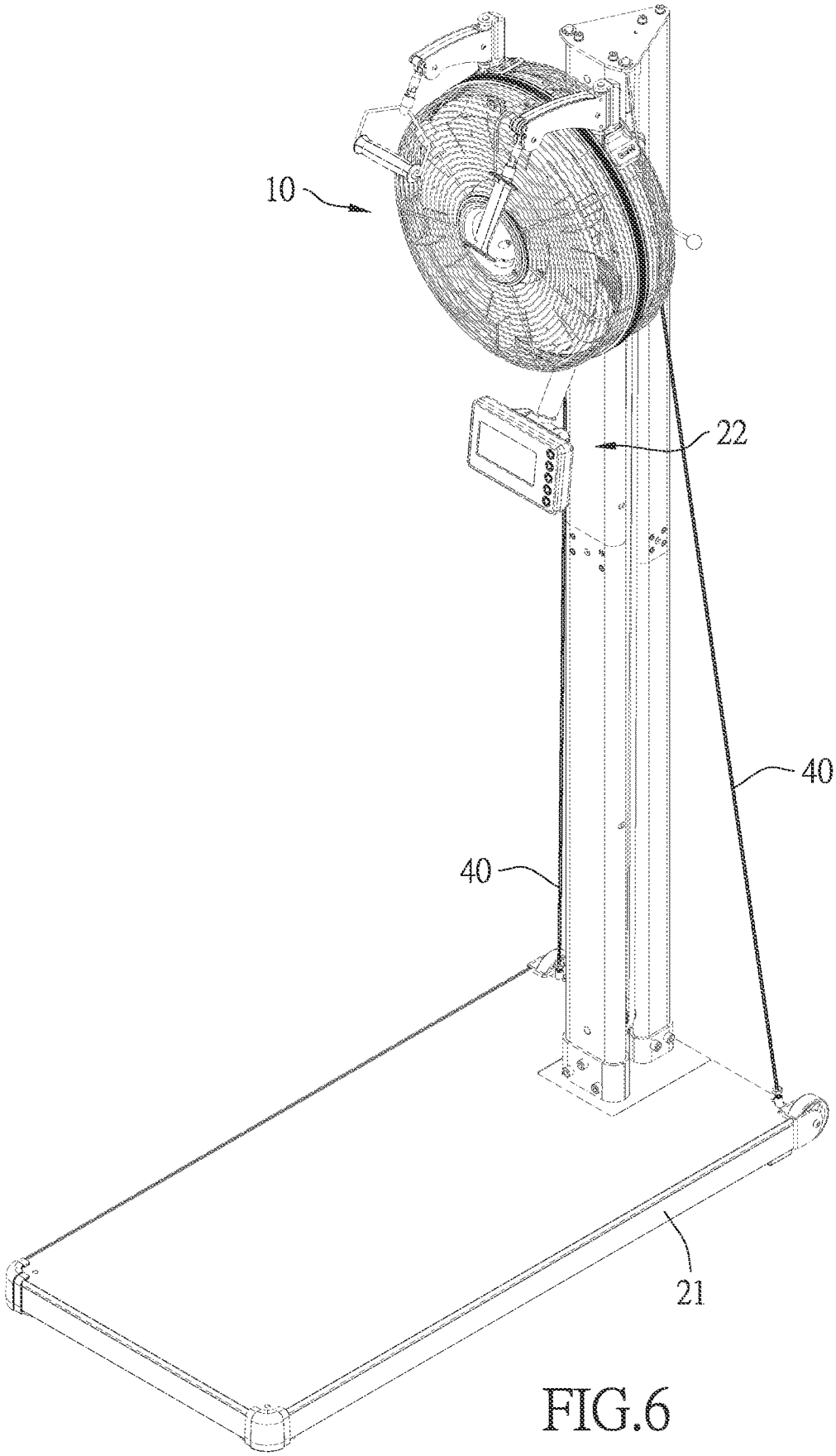
FIG. 6 is a perspective view of the present invention in the third preferred embodiment.
Figure 7:
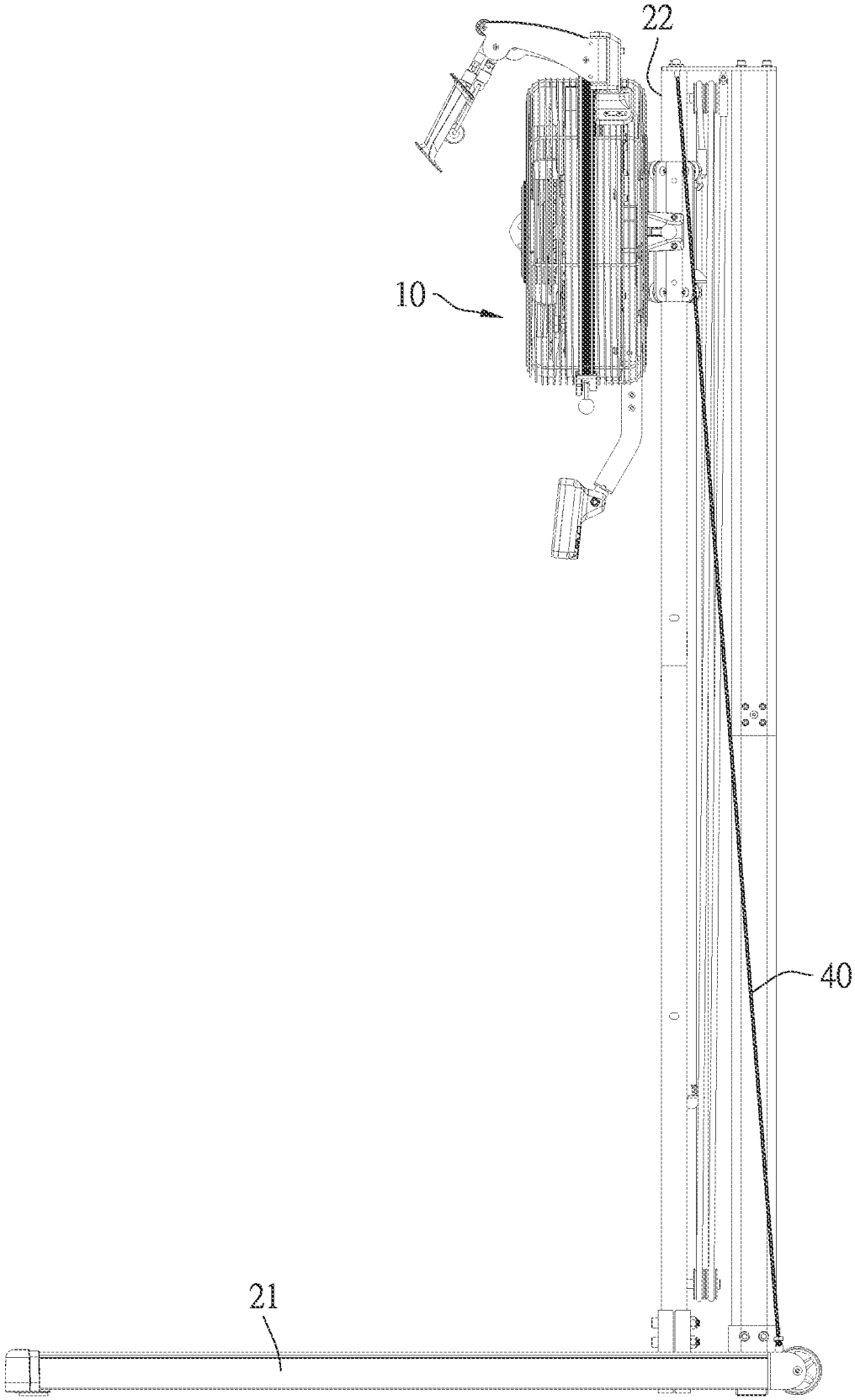
FIG. 7 is a side view of the present invention in the third preferred embodiment.

Please refer to FIGS. 6 and 7, in the third embodiment of the present invention, the angle between the support rod 22 and the base 21 is 90 degrees, and one end of each of the two ropes 40 on two sides of the support rod 22 is connected to a corresponding one of the two sides of the support rod 22, and the two ropes 40 each have another end arranged along the longitudinal direction Z and connected to the base 21. The support rod 22 is pulled through the two ropes 40, and when the user pulls the portable fitness equipment 10 in the direction of a force F, the two ropes 40 can provide sufficient supporting force to prevent the support rod 22 from tilting.

The above is the structural configuration and connection relationship of the present invention in a preferred embodiment. The use of the present invention and the effects it can produce are as follows:

Please refer to FIG. 2, the portable fitness equipment is set on the support rod 22, and the user can adjust the position of the portable fitness equipment on the support rod 22 according to different ways of use. Pulling the first grip rod 133 can disengage the second pivot rod 132 from one of the positioning holes 222 of the support rod 22, so that the portable fitness equipment 10 can slide along the extension direction of the support rod 22, and when the portable fitness equipment 10 is moved to a desired position, pulling the first grip rod 133 again can allow the second pivot rod 132 to be inserted into the corresponding positioning hole 222, so that the portable fitness equipment 10 is fixed to the desired position.

Figure 4:
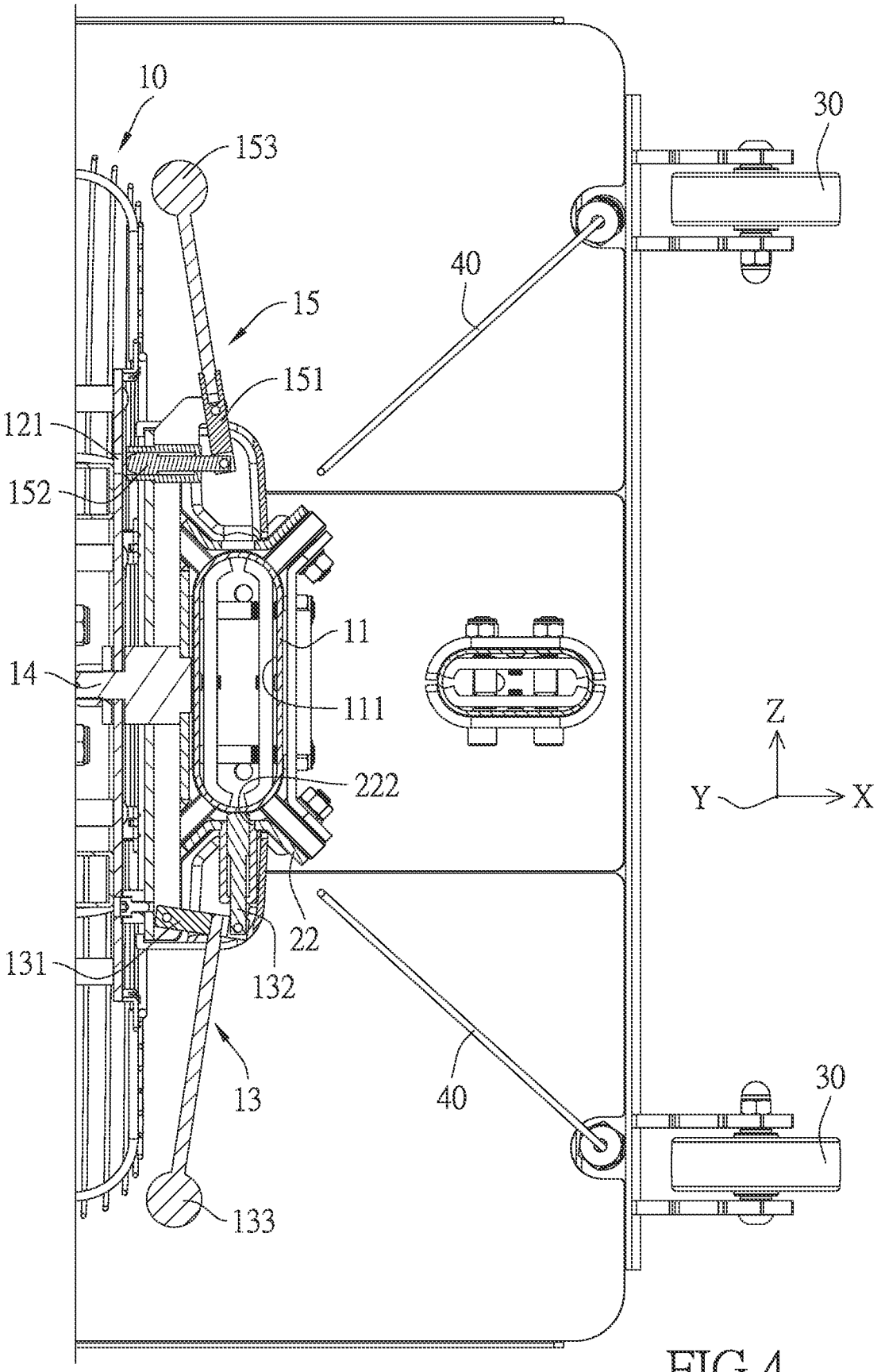
FIG. 4 is a cross-sectional view of the present invention in a preferred embodiment.

Please refer to FIG. 4, when the user wants to rotate the portable fitness equipment 10, he/she first pulls the second grip rod 153 to disengage the second pivot member 152 from the through hole 121, so that the portable fitness equipment 10 can rotate around the pivot shaft 14 and when portable fitness equipment 10 is rotated to a desired position, the user pulls the second grip rod 153 again so that the second pivot member 152 inserts into one of the through holes 121 to fix the portable fitness equipment 10 from rotating.

It is worth mentioning that since one end of the support rod 22 is fixed on the base 21, according to one of the static balance conditions "the resultant moment to any point is zero", the position where the support rod 22 is connected to the base 21 can be defined as $M_0$ and the resultant moment is confirmed to be 0, so the following formula is obtained: $M_0=0$ When the user pulls the portable fitness equipment 10, the force F is as shown by the arrow in FIG. 2, and the base 21 extends from the horizontal direction X, so that there are a first angle θ between the base 21 and the force F, and a second angle δ between the support rod 22 and the vertical direction Y; the force F is divided into a horizontal force $F_x$ and a vertical force $F_y$ along the horizontal direction X and the vertical direction Y, respectively take the force arms perpendicular to the horizontal force $F_x$ and the vertical force $F_y$, and then substitute them into the previous formula:

$$M0=0 \rightarrow M0-F_x \cdot L \cos \delta + F_y \cdot L \sin \delta = 0; F_x = F \cos \theta, F_y = F \sin \theta;$$

the following equation can be obtained after substitution into the previous formula: $M0=F \cos \theta \cdot L \cos \delta - F \sin \theta \cdot L \cos \delta$ According to the previous formula, it can be proved that the greater the first angle θ, the smaller the torque at the $M_0$ position, so it can withstand a greater force F, which means that when the user pulls the portable fitness equipment 10 with a greater force F, it is not easy to cause the position where the support rod 22 is connected to the base 21 to be loose or damaged.

This not only allows the user to adjust the portable fitness equipment 10 to the most suitable position according to personal needs, but also increases the support of the support rod through the obtuse angle between the support rod 22 and the base 21. Even if the user pulls the portable fitness equipment 10 forcefully, the support rod 22 can still provide excellent torque resistance and prevent the position where the support rod 22 is connected to the base 21 from loosening or breaking. In addition, stronger support force can be provided through the ropes 40 and the reinforcing rod 23.

What is claimed is:

1. A positioning device for a portable fitness equipment, comprising:

the portable fitness equipment including a connecting portion; and a support frame including a base, and a support rod standing on the base, the portable fitness equipment being disposed on the connecting portion, a surface of the support rod facing the portable fitness equipment defined as a first surface, a surface of the base facing the portable fitness equipment being defined as a second surface, and an obtuse angle being formed between the first surface and the second surface;

wherein the connecting portion is additionally provided with a positioning module which includes a first pivot rod and a second pivot rod, the first pivot rod includes one end pivotally connected to the connecting portion, and another end pivotally connected to the second pivot rod, a first grip rod is fixedly connected to the first pivot rod, the support rod is provided with a plurality of positioning holes arranged along an extension direction of the support rod;

wherein the portable fitness equipment includes an actuating portion connected to the connecting portion, the connecting portion is additionally provided with a rotating module, the rotating module includes a first pivot member and a second pivot member, the first pivot member includes two ends pivotally to the connecting portion and the second pivot member, respectively, a second grip rod is fixedly connected to the first pivot member, and the actuating portion includes a plurality of through holes that open toward the second pivot member, and each of the through holes is provided for insertion of the second pivot member.

2. The positioning device for the portable fitness equipment as claimed in claim 1, wherein a direction extending from the support rod to the portable fitness equipment is defined as a horizontal direction, a direction extending from the base to the portable fitness equipment is a vertical direction which is perpendicular to the horizontal direction, a longitudinal direction is perpendicular both to the horizontal and the vertical, and one edge of the base is provided with two rollers arranged along the longitudinal direction.

3. The positioning device for the portable fitness equipment as claimed in claim 1, wherein a direction extending from the support rod to the portable fitness equipment is defined as a horizontal direction, a direction extending from the base to the portable fitness equipment is a vertical direction which is perpendicular to the horizontal direction, a longitudinal direction is perpendicular both to the horizontal and the vertical, two ropes are connected to two sides of the support rod, the two ropes each have one end connected to the two sides of the support rod, and another end arranged along the longitudinal direction and connected to the base, and the another end of each of the two ropes fixed to the base is away from the support rod in the horizontal direction.

4. The positioning device for the portable fitness equipment as claimed in claim 3, wherein the support frame includes a reinforcing rod and a connecting piece, the reinforcing rod is arranged between the two ropes, an obtuse angle is formed between the reinforcing rod and the base, the reinforcing rod and the support rod are inclined at the same angle and in the same direction, and the connecting piece is connected to the support rod and the reinforcing rod.

5. The positioning device for the portable fitness equipment as claimed in claim 1 further comprising a support assembly, wherein the support assembly includes a top pulley and a bottom pulley fixed on the support rod, and an elastic cord wound around the top pulley and the bottom pulley, one end of the elastic cord is fixed to the top pulley, and another end of the elastic cord is fixed to the connecting portion.

6. The positioning device for the portable fitness equipment as claimed in claim 1, wherein the portable fitness equipment includes a monitoring device, the monitoring device includes a monitoring circuit and a bracket, the bracket is fixed to the portable fitness equipment, and the monitoring circuit is connected to the bracket through a universal connector.

* * * * *